US006196130B1

(12) United States Patent
Crist et al.

(10) Patent No.: US 6,196,130 B1
(45) Date of Patent: Mar. 6, 2001

(54) ELECTROSTATIC ARMING APPARATUS FOR AN EXPLOSIVE PROJECTILE

(75) Inventors: Scott D. Crist, Minnetonka; Kenneth D. Ceola, Apple Valley, both of MN (US)

(73) Assignee: Alliant Techsystems Inc., Hopkins, MN (US)

( * ) Notice: Subject to any disclaimer, the term of this patent is extended or adjusted under 35 U.S.C. 154(b) by 0 days.

(21) Appl. No.: 09/158,048

(22) Filed: Sep. 22, 1998

(51) Int. Cl.[7] ..... F42C 13/00; F42C 15/00

(52) U.S. Cl. ..... 102/221; 102/200; 102/206; 102/211; 102/247; 89/6.5

(58) Field of Search ..... 102/200, 206, 102/207, 211, 212, 213, 218, 219, 221, 247; 89/6, 6.5

(56) References Cited

U.S. PATENT DOCUMENTS

| | | | | |
|---|---|---|---|---|
| 2,505,042 | * | 4/1950 | Gourdon | 102/211 |
| 3,722,415 | | 3/1973 | Lunt | 102/70.2 |
| 3,838,645 | | 10/1974 | Finger et al. | 102/70.2 |
| 3,871,296 | | 3/1975 | Heilprin et al. | 102/70.2 |
| 3,877,378 | * | 4/1975 | Clark et al. | 102/211 |
| 3,886,867 | * | 6/1975 | Krupen | 102/211 |
| 3,889,599 | | 6/1975 | Apstein | 102/70.2 |
| 4,291,627 | * | 9/1981 | Ziemba et al. | 102/211 |
| 4,972,775 | | 11/1990 | Hoyt et al. | 102/211 |
| 4,991,508 | * | 2/1991 | Ziemba | 102/211 |
| 5,265,539 | | 11/1993 | Kurschner et al. | 102/206 |
| 5,275,107 | | 1/1994 | Weber et al. | 102/251 |
| 5,497,704 | | 3/1996 | Kurschner et al. | 102/264 |
| 5,557,059 | | 9/1996 | Warren et al. | 102/434 |
| 5,693,906 | | 12/1997 | Van Sloun | 102/251 |

FOREIGN PATENT DOCUMENTS

| | | | | |
|---|---|---|---|---|
| 434 243 A2 | | 6/1991 | (EP) . | |
| 192885 | * | 11/1982 | (JP) | 102/211 |

* cited by examiner

*Primary Examiner*—Harold J. Tudor
(74) *Attorney, Agent, or Firm*—Vidas, Arrett & Steinkraus, P.A.

(57) ABSTRACT

The inventive environment sensor apparatus includes an electrostatic sensor carried by the projectile. The electrostatic sensor has first and second electrical conducting areas separated by a dielectric material to form two plates of a capacitor. The first electrical conducting area is conductively connected to a current-to-voltage converter and the second electrical conducting area is conductively connected to the outside projectile body surface. A time changing electric field surrounding the projectile causes a time changing current to flow within the electrostatic sensor, which is converted to a time changing voltage by the current-to-voltage converter. A threshold detector device is conductively connected to an output of the current-to-voltage converter and provides a voltage signal to the safe and arm mechanism when the time changing voltage signal from the current-to-voltage converter exceeds a predetermined level, to indicate that a change has occurred in the sensed muzzle exit environment.

7 Claims, 2 Drawing Sheets

ELECTROSTATIC TRANSDUCER GUNFIRE ANALOG SIGNATURE

ELECTROSTATIC ARMING APPARATUS FOR AN EXPLOSIVE PROJECTILE

FIELD OF THE INVENTION

This invention relates generally to a fuze device for an explosive projectile, and more particularly to a second environment sensor apparatus for detecting the exit of the projectile from the muzzle subsequent to firing in order to maintain fuze system safety and for initiating the timing for subsequent fuze functions.

BACKGROUND OF THE INVENTION

A safety and arming device is a required element of a munition to ensure that the munition is not armed and detonated until the desired time. The safety and arming device (S & A) is part of a munition's fuze and prevents arming of the fuze until certain conditions are met.

Many safety and arming devices require two environments or occurrences for operation and initiation of the fuze. The environments are two independent physical events which must be sensed by the projectile or munition prior to allowing arming. The first environment utilized is usually setback, which is both easily sensed and well known in the art. For example, commonly assigned patent U.S. Pat. No. 5,693,906 describes a first environment sensing device which utilizes setback. The second environment can be based on a number of different parameters such as timing, barrel escape, turns counting, etc. In addition, various techniques for determining muzzle or bore exit are known. For example, commonly assigned patents U.S. Pat. No. 5,497,704 and U.S. Pat. No. 5,265,539 both utilize magnetic sensors to determine muzzle exit. Commonly assigned patent U.S. Pat. No. 5,275,107 determines muzzle exit based on setback acceleration going to zero. The entire contents of commonly owned patents U.S. Pat. Nos. 5,693,906, 5,497,704, 5,265,539 and 5,275,107 are hereby incorporated by reference.

All of these prior art techniques for determining the second environment of muzzle exit require additional circuitry, which adds to the complexity of the device. What is needed is a technique for determining the second environment of muzzle exit with the circuitry which is already included in the munition.

SUMMARY OF THE INVENTION

Applicant has discovered an inventive technique for determining the second environment of muzzle exit, which utilizes existing circuitry on a munition. In particular applicant has discovered a technique for utilizing an inventive proximity sensor to also sense muzzle exit.

The inventive environment sensor apparatus includes an electrostatic sensor carried by the projectile. The electrostatic sensor has first and second electrical conducting areas separated by a dielectric material to form two plates of a capacitor. The first electrical conducting area is conductively connected to a current-to-voltage converter and the second electrical conducting area is conductively connected to the outside projectile body surface. A time changing electric field surrounding the projectile causes a time changing current to flow within the electrostatic sensor, which is converted to a time changing voltage by the current-to-voltage converter. A threshold detector device is conductively connected to an output of the current-to-voltage converter and provides a voltage signal to the safe and arm mechanism when the time changing voltage signal from the current-to-voltage converter exceeds a predetermined level, to indicate that a change has occurred in the sensed environment.

Applicant is the owner of Ser. No. 08/668690 filed Jun. 24, 1996, now issued as U.S. Pat. No. 6,094,054 on Jul. 25, 2000, and entitled "Radome Nose Cone Probe Apparatus For Use With Electrostatic Sensor", the entire contents of which are hereby incorporated by reference. In working with this invention, which utilizes an electrostatic sensor as a proximity detector, applicant discovered a sharp voltage spike associated with the projectile exit from the muzzle. At first this voltage spike was thought to be merely "noise". However, after investigation, Applicant discovered that this voltage spike was caused by the ionized gas "blow-by" associated with the projectile exiting the muzzle. The ionized gas "blow-by" creates an electric field which results in a voltage which when it exceeds a predetermined threshold indicates muzzle exit.

The use of the electrostatic sensor to detect the second environment condition of muzzle exit provides some advantages in that the electrostatic sensor is already used for proximity sensing. Therefore, the use of the electrostatic sensor to perform another function saves in cost and weight and reduces complexity which provides for a more reliable device.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
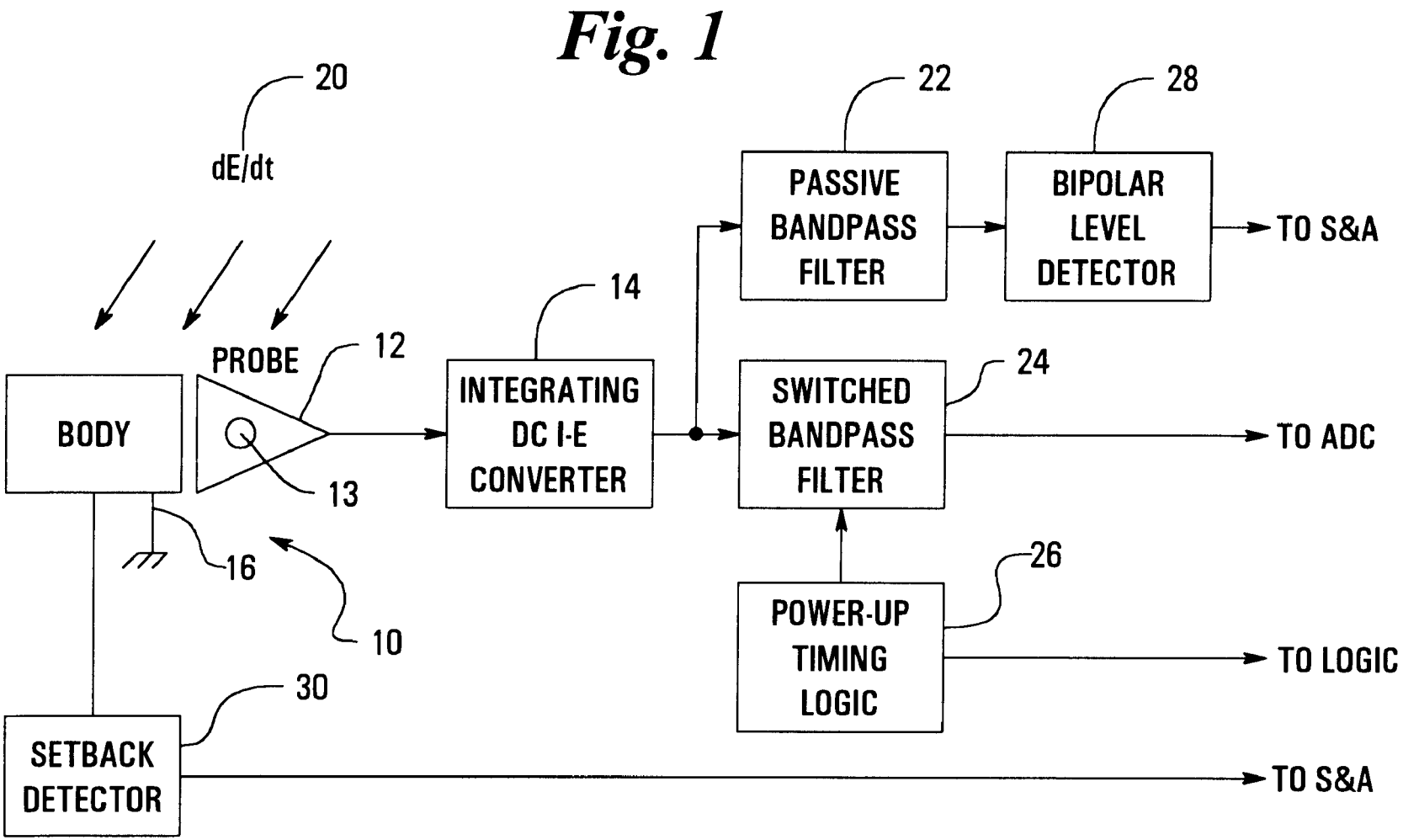
FIG. 1 is a block diagram of the environment sensor apparatus utilizing the invention.

Referring now to FIG. 1, a block diagram of the environment sensor apparatus is shown in which the projectile is shown generally at 10. The projectile 10 carries the inventive electrostatic sensor, which is a capacitor formed of a first conducting area in the probe 12 conductively connected to a current-to-voltage converter 14, the first conducting area in the probe being separated by a dielectric material from a second conducting area connected to the outside projectile body surface 16. As discussed in more detail in copending application Ser. No. 08/668690, now issued as U.S. Pat. No. 6,094,054 on Jul. 25, 2000, the probe contains a ring electrode 13 which is one plate of a sensor capacitor, with the other plate of the capacitor being formed by the projectile body 16, which is connected to circuit ground. As that copending application makes clear, the probe body 12 is made from a dielectric material. A first environment setback detector 30, which is well known in the art as discussed above in the background section, is included in the projectile 10. The setback detector 30 provides a voltage signal to the safety and arming mechanism.

As the projectile moves toward the muzzle exit, ionized gas "blow-by" creates electric field which changes over time, shown schematically at 20. The time changing electric field 20 causes a time changing current to flow within the electrostatic sensor, which is converted to a time changing voltage by the current-to-voltage (DC) converter 14. Projectile body 16 is connected to circuit ground while the electrode ring of probe 12 is connected to the inverting virtual ground input of the converter 14. This creates a "shorted" sensor capacitor configuration in which no voltage is developed between the two plates of the capacitor, but instead current flows. Hence, the time changing electric field (dE/dt) 20 enveloping the projectile causes a time changing output current (dI/dt) to flow within the sensor probe 12 and converter 14 converts this time changing current to a time changing voltage (dV/dt) which is processed by the sensor circuitry. The "shorted probe" I-E converter configuration 14 is known in the art and is the preferred embodiment in sensors of this type.

The output of converter 14 is input to passive bandpass filter 22 and switched bandpass filter 24. Switched bandpass filter is controlled by power-up timing logic block 26 which enables the sensor to operate in its proximity sensor mode only after safe separation is achieved, approximately 60 meters in the preferred embodiment. The circuitry connected to switched bandpass filter 24 is associated with the proximity sensor function and is discussed more in copending application Ser. No. 08/668690, now issued as U.S. Pat. No. 6,094,054 on Jul. 25, 2000, and therefore will not be discussed in detail herein.

Passive bandpass filter 22 is configured to allow the high frequency signals between approximately 1 to 3 Khz through, which are associated with muzzle exit of projectile 10. Filter 22 is connected to bipolar level detector 28 which outputs a second environment voltage to the well known safety and arming device (S & A) of the munition when the signal voltage exceeds a predetermined threshold, between approximately 0.5 to 1.0 volts. The bipolar level detector could be replaced by a look-up table if desired, which is well known in the art.

Figure 2:
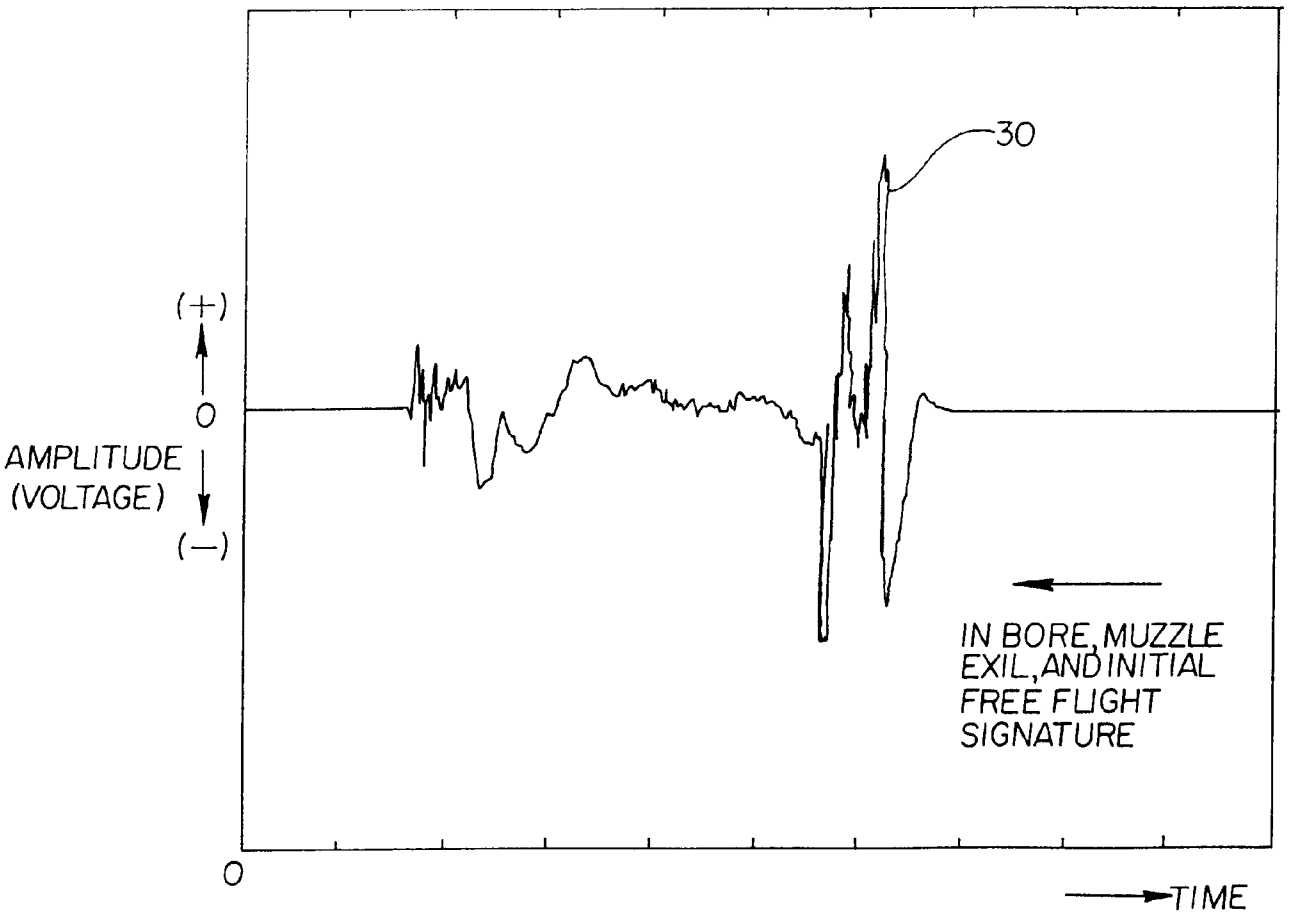
FIG. 2 is a graph showing the voltage spike indicative of muzzle exit.

FIG. 2 shows the analog signature of a test shot as a function of time, with the voltage spike 30 indicating muzzle exit.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is as follows:

1. An environment sensor apparatus for an exploding projectile having a safe and arm mechanism, comprising:

an exploding projectile having an outside projectile body surface;

an electrostatic sensor carried by the projectile, the electrostatic sensor comprised of first and second electrical conducting areas separated by a dielectric material to form two plates of a capacitor, and where the first electrical conducting area is conductively connected to a current-to-voltage converter and the second electrical conducting area is conductively connected to the outside projectile body surface, wherein a time changing electric field surrounding the projectile, caused by ionized gas "blow-by" associated with the projectile exiting a muzzle causes a time changing current to flow within the electrostatic sensor, which is converted to a time changing voltage by the current-to-voltage converter;

a threshold detector device conductively connected to an output of the current-to-voltage converter for providing a voltage signal to the safe and arm mechanism when the time changing voltage signal from the current-to-voltage converter exceeds a predetermined level, to indicate that a change has occurred in the sensed environment.

2. The environment sensor apparatus of claim 1 wherein the voltage predetermined level is between approximately 0.5 to 1.0 volts.

3. The environment sensor apparatus of claim 1 wherein the time changing electric field caused by ionized gas "blow-by" associated with the projectile exiting the muzzle causes the voltage signal to exceed the predetermined level of the threshold detector device, indicating that the projectile has exited the muzzle.

4. The environment sensor apparatus of claim 3 further including a setback inertial force detector which provides a voltage signal to the safe and arm mechanism upon a predetermined acceleration of the projectile, and where the safe and arm mechanism is configured and arranged to generate an arm signal to arm the projectile only if voltage signals indicating that both the projectile setback acceleration is over a predetermined level and that the projectile has exited the muzzle.

5. The environment sensor apparatus of claim 4 wherein the safe and arm mechanism is configured and arranged to arm the projectile only when the projectile is a safe separation distance from the muzzle.

6. The environment sensor apparatus of claim 5 wherein the safe separation distance is approximately 60 meters.

7. The environment sensor apparatus of claim 1 further including a proximity detector mode and being conductively connected to the current-to-voltage converter for detonating the projectile in response to a predetermined time changing voltage signal induced by an electric field surrounding an electrostatically charged target.

* * * * *